United States Patent [19]

Shimizu

[11] 4,293,236

[45] Oct. 6, 1981

[54] PRINTER

[75] Inventor: Munetaka Shimizu, Kawagoe, Japan

[73] Assignee: Copal Company Limited, Tokyo, Japan

[21] Appl. No.: 91,742

[22] Filed: Nov. 6, 1979

[30] Foreign Application Priority Data

| | | | |
|---|---|---|---|
| Nov. 20, 1978 | [JP] | Japan | 53-143033 |
| Nov. 20, 1978 | [JP] | Japan | 53-159795[U] |
| Nov. 20, 1978 | [JP] | Japan | 53-159796[U] |
| Nov. 20, 1978 | [JP] | Japan | 53-159797[U] |

[51] Int. Cl.[3] ..... B41J 11/48

[52] U.S. Cl. ..... 400/593; 101/93.07

[58] Field of Search ..... 400/593, 584, 585, 585.1, 400/586, 588, 703; 101/93.07, 93.08, 93.09, 93.11, 93.48, 95

[56] References Cited

U.S. PATENT DOCUMENTS

| | | | |
|---|---|---|---|
| 3,128,693 | 4/1964 | Thiemann | 101/93.09 |
| 3,220,343 | 11/1965 | Wasserman | 101/93.09 |
| 3,267,843 | 8/1966 | Lemelson | 101/93.07 X |
| 3,893,389 | 7/1975 | Kodis | 101/93.07 |
| 3,966,037 | 6/1976 | Zambolin | 400/585 |
| 3,973,486 | 8/1976 | Pylant | 101/93.07 X |
| 4,011,811 | 3/1977 | Kodis | 101/93.11 X |
| 4,149,458 | 4/1979 | Clary | 101/93.07 |
| 4,167,345 | 9/1979 | Englund et al. | 400/593 X |
| 4,189,997 | 2/1980 | Nozaki et al. | 101/93.09 |
| 4,211,498 | 7/1980 | Shimizu et al. | 101/93.07 X |

OTHER PUBLICATIONS

"Magnet", IBM Tech. Discl. Bulletin, vol. 9, No. 4, Sep. 1966, p. 392.

"Solenoid Structure Having Enhanced Force", IBM Tech. Discl. Bulletin, vol. 22, No. 5, Oct. 1979, p. 1744.

*Primary Examiner*—E. H. Eickholt

*Attorney, Agent, or Firm*—McAulay, Fields, Fisher, Goldstein & Nissen

[57] ABSTRACT

A printer of the type in which a receipt paper and a journal paper are arranged in parallel to each other, after the receipt paper and journal paper have been transferred in a horizontal direction, the receipt paper is passed through a vertically moving cutter device and issues from the printer in a horizontal direction whereas the journal paper is turned upwardly and wound about a take-up roll; printing drums for the receipt paper and the journal paper are disposed below a horizontal paper transfer plane and printing devices for the receipt paper and the journal paper are disposed above the horizontal paper transfer plane to print on the undersurfaces of the papers, which makes it easy to mount an optical printing drum position detector on the printer.

11 Claims, 10 Drawing Figures

PRINTER

BACKGROUND OF THE INVENTION

The present invention relates to a printer and, more particularly, to a printer which makes it possible to effect a multi-item validation printing.

Furthermore, the present invention relates to an electromagnetic plunger-type printing device for effecting printing by hammering in the printer.

And the present invention relates to a cutter device for a receipt paper in the printer.

Still furthermore, the present invention relates to a mounting arrangement of an optical detector having luminous and light receiving elements effective to the control of the operation of the printer.

A variety of printers of the type in which a receipt paper and a journal paper are arranged in parallel to each other have been proposed, but any one of the prior art printers of the above type is so designed that the receipt paper is printed by a receipt paper printing drum, then fed upwardly and lastly cut by a moving cutter transversely. In the prior art printer of the design, the printed receipt paper is fed upwardly along the associated printing drum and cut in the fed position, and accordingly, scraps generated in the receipt paper cutting drop and tend to adhere to the printing drum resulting in improper printing. And since the receipt paper is cut transversely in the upwardly fed position, receipt paper sections cut off the rest of the receipt paper leap and accordingly, it is necessary to manually take these cut receipt paper sections out of the printer and such manual operation is inconvenient.

Printers combined with both receipt paper and journal paper printing drums or either one of the printing drums so as to effect validation printing have been also proposed, but the printer of this type is also basically the above-mentioned printer having a validation printing mechanism added thereto and has the same disadvantages as those inherent in the above-mentioned printer and is capable of effecting only the last validation item, for example, of a multi-item validation printing because the printer is designed to feed the receipt paper upwardly which is unsatisfactory from the viewpoint of practical use.

Furthermore, it has been also known of the printing device of a printer of the type in which a receipt paper and a journal paper are transferred along their respectively associated printing drums and a selected hammer of the printing device disposed on the side of each of the papers opposite to the associated printing drum is actuated through the energization of an electromagnetic plunger so as to strike against the printing drum with the paper interposed therebetween whereby characters formed on the outer periphery of the rotating printing drum are selectively printed on the associated paper by controlling the striking time.

In this electromagnetic plunger type printing device, in order that the hammers of the printing device which correspond to the character rows on the printing drum adapted to be rotatably driven can precisely strike against the character rows, the common shaft of the hammers is journalled in the printer main body in a parallel relationship to the shaft of the printing drum. On the other hand, electromagnetic plungers for actuating the hammers are adapted to be mounted in a yoke and integrally secured to the printer main body to operatively connect between the hammers and plungers.

Thus, the hammers are mounted on their shaft in a precise position relative to the printing drum, but the yoke adapted to be mounted on the printer main body for maintaining the hammers and plungers in operative connection should be adjustably positioned so as to determine the striking force of the hammers which depends upon the operative connection between the hammers and plungers and thus, the adjustment of the mounting position of the yoke is troublesome.

In the printer in which the receipt paper and journal paper are arranged in parallel to each other, as the cutter device for cutting or perforating the receipt paper, use has been made of the cutter which includes a cutter and a cutter guide and is designed to cut or perforate the receipt paper interposed between the cutter and cutter guide by advancing the cutter into the slit in the cutter guide.

This type of prior art cutter device is designed to cause the cutting edge of the cutter to directly advance into the slit in the cutter guide and accordingly, the adjustment and maintenance of the relative position between the cutter and slit are difficult and present a problem in assembling the cutter device. And although it is desirable that the width of the slit in the cutter guide is limited to a value close to the thickness of the cutter to improve the sharpness of the cutter, it has been impossible to reduce the difference in sizes between the slit width and cutter thickness because of the above-mentioned reason and processing preciseness.

In the above-mentioned printer, an optical detector has been employed as means for detecting the position of the rotating printing drum to thereby select a character to be printed. Generally, since the printing drum is disposed within the printer, a disc having a plurality of openings therein is employed in combination with the printing drum for detecting the position of the rotating drum. In this case, a luminous element and a light receiving element are disposed adjacent to the opposite sides of the disc and accordingly, since the optical detector should be mounted in a limited space within the printer, the mounting of the detector is not easy because precise positioning of the detector is required and a separate cover should be attached to the detector for shielding the optical elements from external light.

SUMMARY OF THE INVENTION

The present invention aims at avoid the above-mentioned disadvantages inherent in the prior art printers.

One object of the present invention is to provide a printer which eliminates the disadvantages inherent in the above-mentioned prior art printers, which has a construction making it easy to effect a multi-item validation printing and which is excellent from the view point of practical use.

Another object of the present invention is to provide the structure of a printing device which eliminates the difficulties in assembling the above-mentioned printer and which makes it easy to assemble the printer.

A further object of the present invention is to provide a cutter device for the above-mentioned printer which can be easily assembled and which can reduce the slit width of the cutter guide so as to improve the sharpness of the cutter.

Another object of the present invention is to provide a mounting structure for an optical detector which makes it easy to assemble the above-mentioned printer and eliminates a separate light shielding cover.

In order to attain the above-mentioned objects of the present invention, in a printer in which a receipt paper and a journal paper are disposed in parallel to each other, it is characterized by the fact that the receipt paper and journal paper are transferred along their respectively associated printing drums in a horizontal direction, the receipt paper and journal paper are struck against their associated printing drums by the hammers of printing devices positioned above the papers, respectively, to effect printing on the undersurfaces of the papers and the printed journal paper is turned upwardly to be wound about a take-up roll whereas the printed receipt paper is transferred in a horizontal direction and passed through an upwardly and downwardly movable cutter device in which the printed receipt paper is cut by the upward and downward movement of the cutter in the cutter device.

Thus, since the side of the journal paper to be printed faces the operator of the printer, the operator can always monitor the printing operation and on the other hand, since the receipt paper is transferred towards the operator in a horizontal direction, undesired leap of cut sections of the printed receipt paper in a wrong direction can be eliminated to thereby eliminate difficulties which may be caused by general scraps.

And since both the papers are transferred in a horizontal direction when printing is effected on the papers, the transfer distance of these papers is relatively long. Thus, when a validation paper is inserted between the receipt paper and the associated printing drum, for example, and these papers are simultaneously transferred, a multi-item validation printing can be easily attained.

Furthermore, according to another feature of the present invention, when the hammers and plungers are mounted in a predetermined position relative to the yoke, the assembly forms a block structure and the block structure can be secured to the printer main body in a proper position relative to the printing drums with the shaft of the hammers as the reference.

Furthermore, according to another feature of the present invention, the cutter in the printer is formed with guide projections and the slit in the cutter guide is formed with guide faces. Thus, when the guide projections are guided along the guide faces in the operation of the cutter, the cutter is guided into the slit as the cutter advances into the slit to thereby minimize the slit width.

According to another feature of the present invention, a detection section including a luminous element and a light receiving element are secured to a base to form an optical detector, the printer main body is formed with an opening and the detection section is inserted into the printer main body to a predetermined position through the opening so as to cause the base to shield the opening from external light.

In this way, since the base of the detection section concurrently serves as a light shielding member for the detection section inserting opening in the printer main body, a separate light shielding plate can be eliminated and the position of the detection section can be adjusted from outside as the detection section base is secured to the printer main body to thereby substantially simplify the assembling operation of the optical detector.

The present invention will be now described below with reference to preferred embodiments thereof as illustrated in the accompanying drawings.

DETAILED DESCRIPTION OF THE PREFERRED EMBODIMENTS

Figure 1:
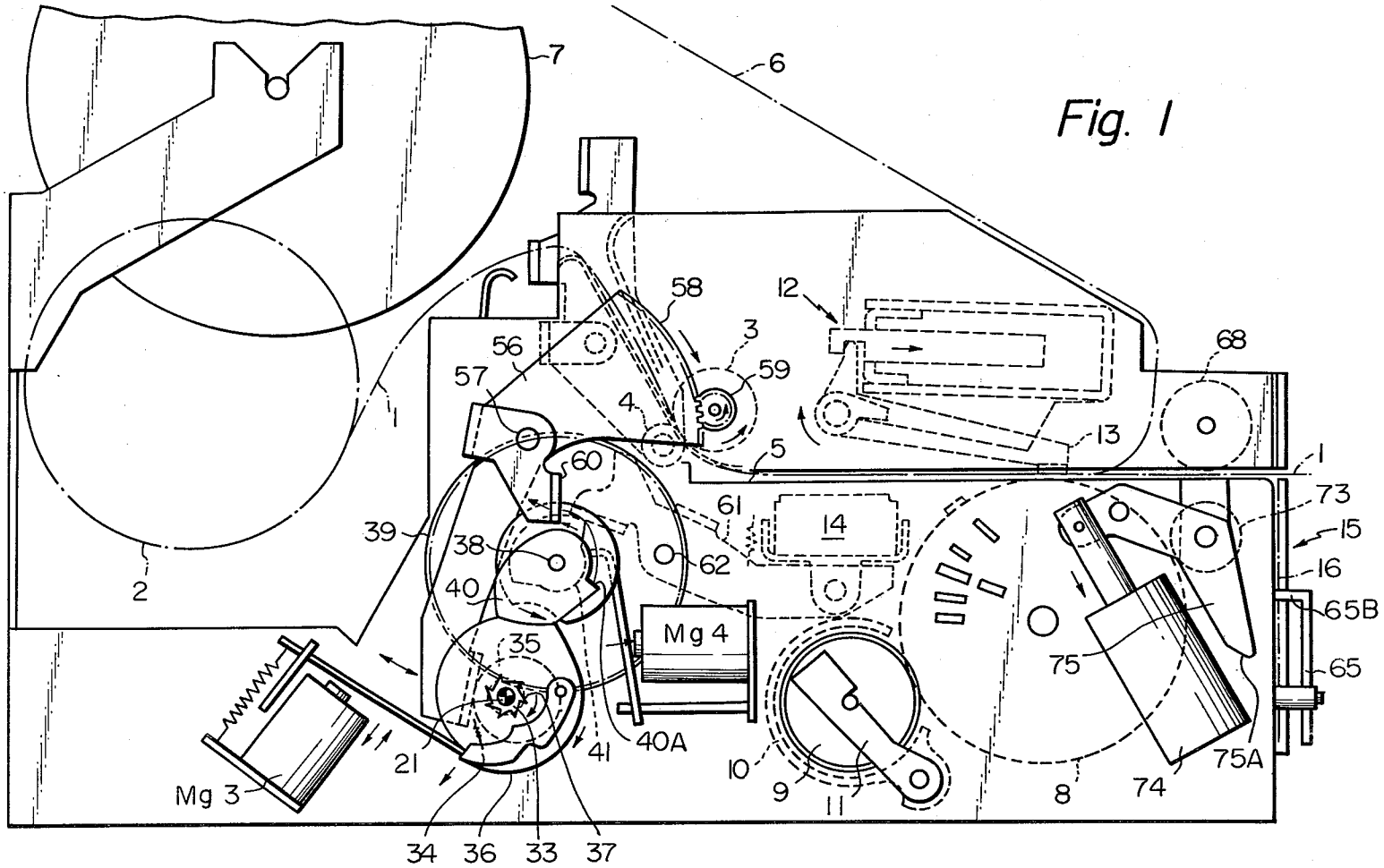
FIGS. 1 and 2 are schematic side elevational views of the printer of the present invention showing the components of the printer as seen from the opposite sides thereof, respectively.
Figure 2:
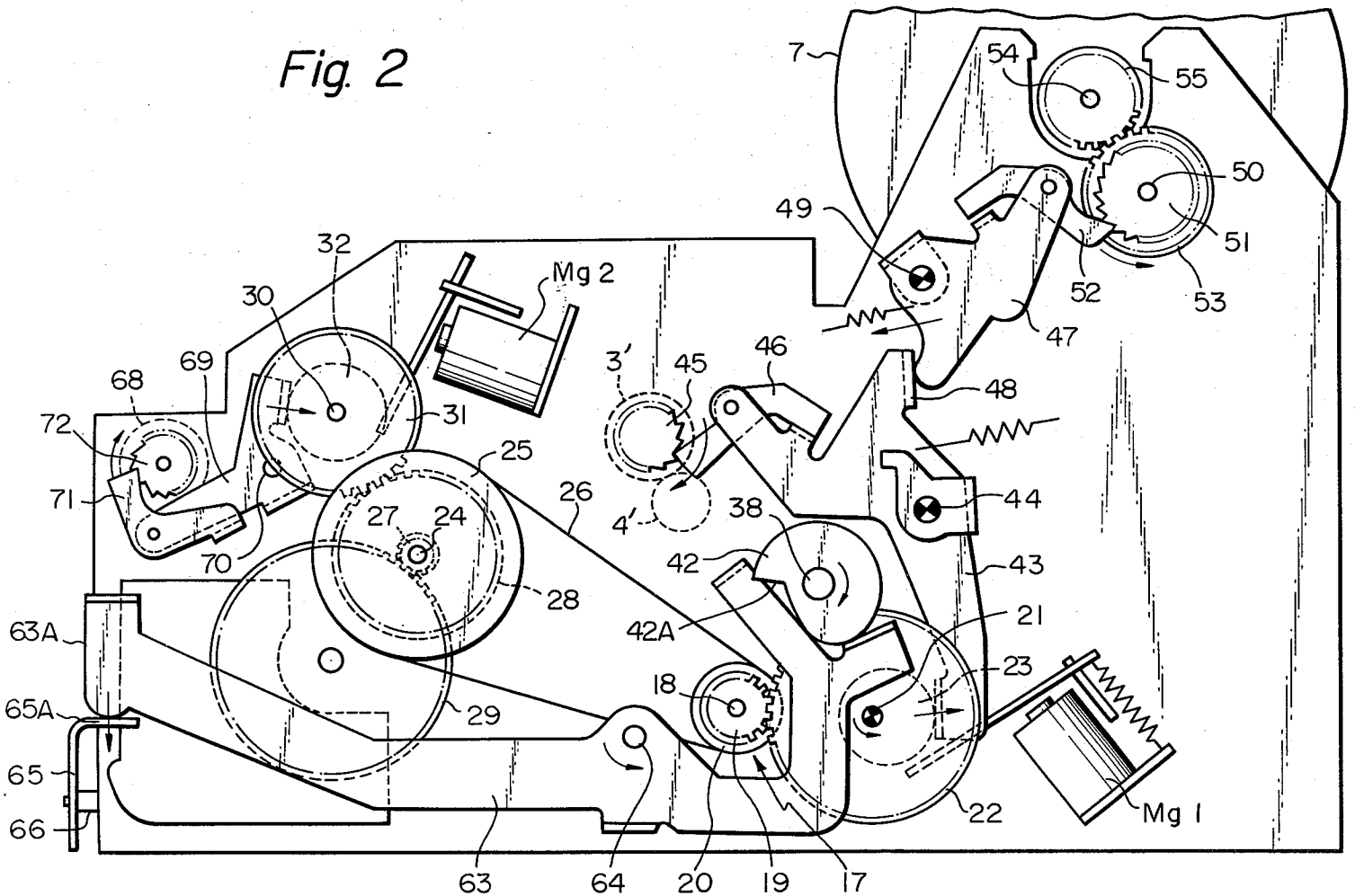

FIGS. 1 and 2 show the various component devices of the printer of the invention as seen from the opposite sides thereof, respectively, wherein a receipt paper 1 paid out of a supply roll 2 is guided along guide rollers and passed to and through the nip between a paper feed roller 3 and a cooperating roller 4 to a horizontal paper transfer plane 5 on which the receipt paper 1 is transferred in a horizontal direction. Similarly, a journal paper 6 paid out of a journal paper supply roll (not shown) which is disposed in parallel to the supply roll 2 is passed to and through the nip between a paper feed roller 3' and a cooperating roller 4' which are similar to the paper feed roller 3' and cooperating roller 4, respectively, to the horizontal paper transfer plane 5 on which the journal paper 6 is transferred in parallel to the receipt paper 1 in the horizontal direction. After having passed through the horizontal paper transfer plane 5, the journal paper 6 is turned upwardly and rolled about a take-up roll 7. The drive mechanism for driving these paper feed rollers 3, 3' which are adapted to transfer the receipt paper and journal paper, respectively, will be described hereinafter.

Disposed below the horizontal paper transfer plane 5 are a receipt paper printing drum 8 and a similar journal paper printing drum (not shown) which correspond to the running paths of the receipt paper 1 and journal paper 6, respectively. Each of these drums is formed on the peripheral surface thereof with a plurality of characters to be printed and rotatably driven in the manner as will be described hereinafter. An ink application roller 9 is disposed adjacent to the character formed peripheral surface of the associated printing drum for applying ink to the printing faces of the characters. The ink application roller 9 is rotatably received within a holder 10 and has the shaft journalled in a support plate 11 so that the ink application roller 9 is urged to contact the peripheral surface of the associated printing drum 8.

A printing device 12 is disposed above the section of each of the receipt paper 1 and journal paper 6 positioned on the horizontal paper transfer plane 5 for effecting printing on the receipt paper 1 or journal paper 6 in cooperation with the associated printing drum 8. As well known in the art, the printing device 12 has a plurality of hammers 13 the number of which corresponds to the number of character rows to be printed on the printing drum 8 and when a desired or selected hammer 13 is actuated through the energization of a conventional electromagnetic plunger (not shown) in a known manner, the hammer strikes against the printing drum 8 at a suitable time point with the receipt paper or journal paper disposed therebetween, a desired or selected character on the printing drum is printed on the undersurface of the paper.

A stamp 14 is also disposed below the horizontal paper transfer plane 5 and is actuated by a mechanism as will be described hereinafter when a desired or predetermined printing operation has completed on the receipt paper 1, for example, to thereby stamp a suitable marking on the undersurface of the receipt paper 1.

The discharge end of the printer from where the printed receipt paper 1 is discharged out of the printer is provided with a cutter device 15 which has a cutter 16 adapted to be slidably moved upwardly and downwardly by a mechanism as will be described hereinafter to cut the printed receipt paper 1 into receipt paper sections.

As more clearly shown in FIG. 2, the printer includes a motor 17 which has the shaft 18 on which a gear 19 and a pulley 20 are mounted. The gear 19 meshes a gear 22 mounted on a shaft 21 which is parallel to the shaft 18 and the gear 22 is mounted on the shaft 21 through a spring clutch (not shown) so that the gear 22 normally rotates freely about the associated shaft, but rotates together with the shaft when a magnet Mg1 is energized to thereby rotatably drive a cam 23 mounted on the shaft 21.

The pulley 20 is drivingly connected through an endless belt 26 to a pulley 25 rigidly connected to a shaft 24 on which gears 27, 28 are mounted. The gear 27 meshes a gear 29 mounted on the shaft on which the printing drum 8 is coaxially mounted so as to normally rotate the printing drum 8. The gear 28 meshes a gear 31 mounted on a shaft 30 and the gear 31 is mounted on the shaft 30 through a spring clutch (not shown). The gear 31 normally rotates freely about the shaft 30, but rotates together with the shaft 30 when a magnet Mg2 is energized so as to rotatably drive a cam 32 mounted on the shaft 30.

As more clearly shown in FIG. 1, the shaft 21 further has a ratchet wheel 33 fixedly secured thereto and also a clutch plate 36 attached thereto and the clutch plate has a pawl 34 adapted to engage the ratchet wheel 33 and a cam 35. When a magnet Mg3 which normally restrains the pawl 34 against engagement with the ratchet wheel 33 is energized, the pawl is released from the restraining force of the magnet to be allowed to engage the ratchet wheel whereby the clutch plate 36 and cam 35 rotate together with the shaft 21. The shaft 21 further has a gear 37 fixedly secured thereto and the gear 37 meshes a gear 39 mounted on a shaft 38 through a spring clutch (not shown). The gear 39 normally rotates freely about the shaft 38, but rotates together with the shaft 38 when a magnet Mg4 is energized to thereby rotatably drive cams 40, 41 and 42 fixedly mounted on the shaft 38 (FIG. 2).

The lever mechanism which cooperates with the above-mentioned cams 23, 32, 35, 40, 41, 42 will be described hereinbelow.

As more clearly shown in FIG. 2, a journal paper feed lever 43 is urged in the clockwise direction about a shaft 44 to abut at one end against the cam 23 and the other end of the lever 43 has a pawl 46 attached thereto for engaging a ratchet wheel 45 associated with the journal paper feed roller 3' whereby each time the lever 43 rocks once, the journal paper feed roller 3' is rotated by one pitch. The lever 43 is formed with an engaging portion 48 adapted to engage a journal paper take-up lever 47. The lever 47 is urged in the clockwise direction about a shaft 49 and has at the other end a pawl 52 adapted to engage a ratchet wheel 51 rigid to a shaft 50 which has a gear 53 attached thereto. The gear 53 meshes a gear 55 mounted on the shaft 54 of the journal paper take-up roll 7 whereby each time the lever 43 rocks once, the journal paper take-up roll 7 is rotated by one pitch.

Similarly, a receipt paper feed lever 56 is urged in the counter-clockwise direction about a shaft 57 as seen in FIG. 1 so as to abut at one end against the cam 35. The other end of the lever 56 is formed with a sector toothed portion 58 having the shaft 57 as its center and the sector toothed portion 58 meshes a gear 59 associated with the receipt paper feed roller 3 whereby each time the lever 56 rocks once, the receipt paper feed roller 3 is rotated by one pitch.

And as shown in FIG. 1, the receipt paper feed lever 56 has an engaging edge 60 integrally formed at one end thereof to be engaged by the raised portion 40A of the cam 40 as the cam rotates. Since the moment arm from the shaft 57 when the raised portion 40A of the cam 40 engages the engaging end edge 60 of the lever 56 to push the latter is small, the rocking angle of the receipt paper feed lever 56 becomes large whereby the meshing between the sector toothed portion 58 and gear 58 augments the receipt paper feed rate per feed from one pitch to nine pitches, for example, to thereby effect a rapid receipt paper feed.

When the lever 61 associated with the stamp 14 is urged in the counter-clockwise direction as shown in FIG. 1 to abut at one end against the cam 41, each time the cam 41 rotates through one complete rotation, the lever 61 is rocked once whereby the stamp 14 prints a stamp marking on the undersurface of the receipt paper 1.

Figure 3:
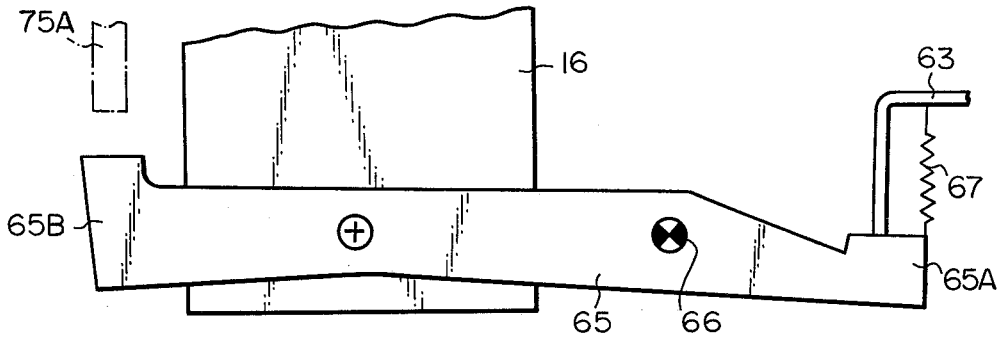
FIG. 3 is a fragmentary schematic end elevational view of the cutter actuation mechanism of the printer as shown in FIG. 1.

As the lever 63 associated with the cutter 16 is urged in the counter-clockwise direction about its shaft 64 as seen in FIG. 2 to abut at one end against the cam 42 and as the cam 42 rotating in the clockwise direction as seen in FIG. 2 rotates through one complete rotation, the shoulder defined by the step 42A on the cam 42 causes the lever 63 to rock in the counter-clockwise direction about the shaft 64 whereupon the other end 63A of the lever 63 pushes down one end 65A of the cutter actuation lever 65 for the cutter device 15 as shown in FIG. 3 whereby the lever 65 rotates in the clockwise direction about a shaft 66 to raise the cutter 16 attached to the lever 65 to cut the receipt paper 1 into receipt paper sections. A return spring 67 is provided for returning the lever 65 and accordingly the cutter 16 to the initial lowered position.

The printer further comprises a validation printing mechanism. For performing the validation printing, a slip such as a single receipt paper the form of which has been predetermined, for example, is inserted from the plane of FIG. 1 into the printer below the receipt paper 1 on the horizontal paper transfer plane 5. For transferring the slip, a slip feed roller 68 is provided adjacent to the discharge opening in the printer. The feed roller 68 is driven by a slip feed lever 69 which follows the rotation of the cam 32 as shown in FIG. 2. The slip feed lever 69 is urged in the clockwise direction about a shaft 70 as seen in FIG. 2 to abut at one end against the cam 32 and the other end of the lever 69 has a pawl 71 attached thereto for engaging a ratchet wheel 72 associated with the roller 68 whereby as the cam 32 rotates through one complete rotation, the feed roller 68 is rotatably driven by one pitch. A roller 73 is adapted to cooperate with the slip feed roller 68 when the roller feeds the slip and journalled in lever 75 is adapted to be operated by an electromagnetic plunger 74 whereby when the plunger 74 is energized, the lever 75 is rocked in the counter-clockwise direction to cause the roller 73 to abut against the slip feed roller 68.

When the roller 73 abuts against the roller 68, the leading end 75A of the lever 75 moves to a position above the other end 65B of the cutter actuation lever 65 through the energization of the plunger 74 to define an upward displacement limit of the end 65B of the lever 65. When the plunger 74 is energized when no validation printing is effected, the rocking angle of the cutter actuation lever 65 is limited whereby a perforated line is cut in the receipt paper 1.

The printing drum 8 adapted to be continuously rotated by the motor 17 has a disc for rotation therewith as is well known in the art and the disc is formed with a plurality of openings in the number corresponding to the characters on the printing drum 8 and one reset opening. An optical printing detector is formed by luminous and light receiving elements disposed adjacent to and from the opposite sides of the disc and resets the printing drum after the drum has rotated through one complete rotation to detect the printed character. A signal of the printed character detected by the detector is sent to a control device (not shown) and when the control device receives a desired character hammering signal, the control device stores the input signal therein and controls the hammer actuation at a predetermined time point to thereby effect a desired character printing by hammering.

As is clear from the foregoing description on the printer of the invention having the construction and arrangement of the components, in operation, the main switch (not shown) is turned on to actuate the motor 17 whereupon the printing drums 8 are rotated. While the printing drums 8 are rotating, the optical detector continuously detects characters to be in succession positioned in the printing position. When the optical detector detects desired characters positioned in the printing position, the detector inputs desired printing commands to the control device which in turn stores the commands therein. When desired or selected characters in the character rows on the printing drums associated with the receipt paper 1 and journal paper 6 are in succession positioned in the printing position while the drums are continuously rotating, the hammers 13 of the printing devices 12 corresponding to the selected or desired characters are actuated to print the characters on the receipt paper and journal paper, respectively, and when all the characters in a desired character row have been printed, the printing for a particular character row is completed. At the completion of the character row printing, the magnet Mg3 is momentarily energized to rotate the shaft 21 for one complete rotation whereby the cam 35 causes the lever 56 to rock once. As the lever 56 rocks, the meshing sector toothed portion 58 and gear 59 feed the receipt paper 1 by one pitch. Simultaneously, the magnet Mg1 is also momentarily energized to rotate the cam 23 through one complete rotation and the rotation of the cam causes the levers 43 and 47 to rock once. As the levers 43 and 47 rock, the pawl 46 of the lever 43 engages the ratchet wheel 45 and the pawl 52 of the lever 47 engages the ratchet wheel 51, respectively, whereby the roller 3' and take-up roll 7 are rotated by one pitch, respectively. In this way, the journal paper 6 is transferred by one pitch in synchronization with the transfer of the receipt paper 1 by one pitch. Thereafter, the above-mentioned operation procedure is repeated for a desired number of times until a desired printing is obtained.

When a programmed printing has completed, the magnet Mg4 is momentarily energized to rotate the shaft 38 and accordingly, the cams 40, 41 and 42 rigid to the shaft rotate through one complete rotation. As these cams rotate through one complete rotation, the cam 40 engages the edge 60 of the lever 56 to rock the lever 56 through a large angle to thereby feed the receipt paper 1 rapidly. Prior to the rapid feed of the receipt paper 1 by the cam 40, the cam 41 rocks the lever 61 whereby the stamp 14 effects stamping. After the rapid feed of the receipt paper 1 by the cam 40, the cam 42 rocks the cutter lever 63 once to actuate the cutter 16 to thereby effect cutting on the receipt paper 1.

When it is desired to form a perforated line on the receipt paper instead of cutting the receipt paper, the plunger 74 is energized to thereby achieve the restraining of the cutter actuation lever 65 by the lever 75.

And when it is desired to effect validation printing, the slip on which the validation printing is performed is previously set on the horizontal paper transfer plane 5 below the receipt paper 1 in the manner as mentioned hereinabove and the plunger 74 is energized. With the plunger 74 maintained in the energized state, the magnet Mg2 is energized to rotate the cam 32 through one complete rotation. Each time the cam 32 rotates through one complete rotation, the pawl 71 of the lever 69 engages the ratchet wheel 72 to rotate the feed roller 68 by one pitch.

The actuation of the printing device, magnets and plungers are automatically and selectively effected by commands from the control device incorporated in the printer and the control device is operated in the manner well known in the art.

As mentioned hereinabove, according to the printer of the present invention, the disadvantages such as adhesion of generated scraps to the printing drums and leap of the cut receipt paper sections can be eliminated and the printer of the invention is practically advantageous in that exchange operation required in the employment of an inked ribbon is eliminated by the combined use of ink application rollers and printing drums and rapid feed can be effected after the completion of a printing operation.

Figure 4:
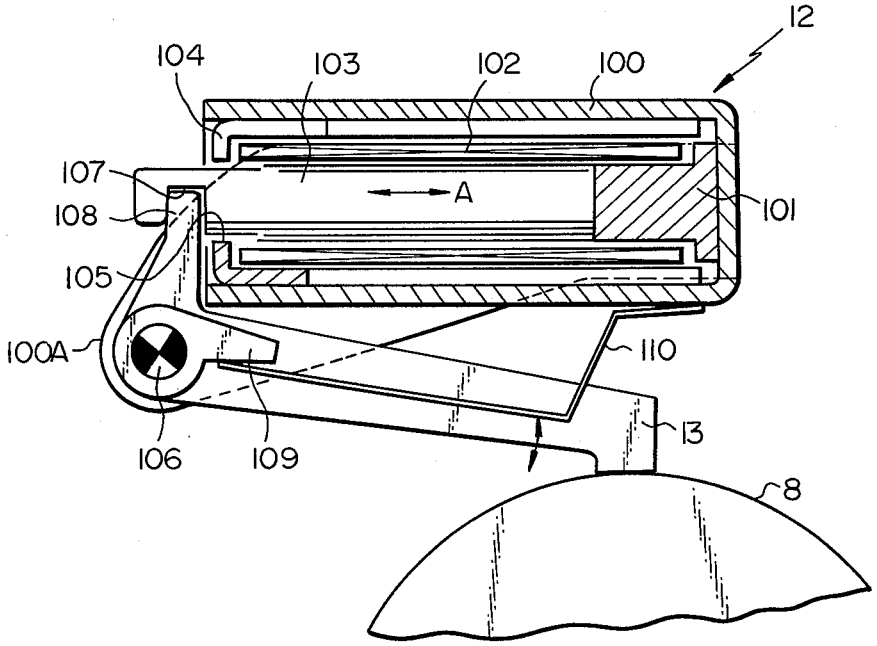
FIG. 4 is a fragmentary side elevational view of the printing device of the printer as shown in FIG. 1.

Detailed description will be now made on the printing device which constitutes another feature of the present invention. The printing device 12 includes a yoke 100 as illustrated in FIG. 4 which shows the printing device in its printing position. The yoke 100 has an electromagnetic iron core 101 and an electromagnetic coil 102 secured thereto and receives a plunger 103 for slidable movement in the axial direction as shown by the arrow A. The plunger 103 extends through an opening 105 in the cap 104 for the yoke 100. The opposite ends of the yoke 100 have flanges 100A integrally formed therewith (the flange 100A at only one end is shown in FIG. 4) for pivotally supporting the hammers 13. The flanges 100A have aligned bores through which a hammer shaft 106 extends and the hammer 13 are pivotally supported on the hammer shaft 106.

The plunger 103 has a recess 107 formed at the leading end thereof and a projection 108 formed at one end of each hammer 13 engages in the recess 107 so that the hammers 13 are pivoted as the plunger 103 moves slidably in the arrow direction A. The hammer 13 is formed with a spring abutment 109 against which one end of a spring 110 which is anchored at the other end to the yoke 100 abuts to urge the hammer 13 in the counterclockwise direction.

That is, the printing device 12 is attached to the yoke 100 in such a manner that all the components of the printing device assume a predetermined relative relationship and provide a block structure.

The block structure is attached to the main body of the printer with the hammer shaft 106 as the reference.

According to the construction and arrangement of the components of the printer of the invention as mentioned hereinabove, since the spaces between the plunger 103 and iron core 101 and the operative connection between the plunger 103 and hammers 13 are maintained in a predetermined relationship by the yoke 100, it is almost unnecessary that the striking force of the hammers 13 be adjusted.

And since the block structure is attached to the main body of the printer with the hammer shaft 106 as the reference, the relative positional relationship between the hammers 13 and printing drums or precise striking of the hammers 13 against the printing drums can be positively and easily obtained.

Although detailed description has not been had on the hammers, it is advantageous that adjacent character rows are formed on the printing drum in a mutually displaced relationship by one half of a pitch and one hammer serves two character rows. In such a case, since a severe relative positional relationship between the hammers and printing drums is required, the construction and arrangement of the components of the printer of the invention are quite advantageous.

Figure 5:
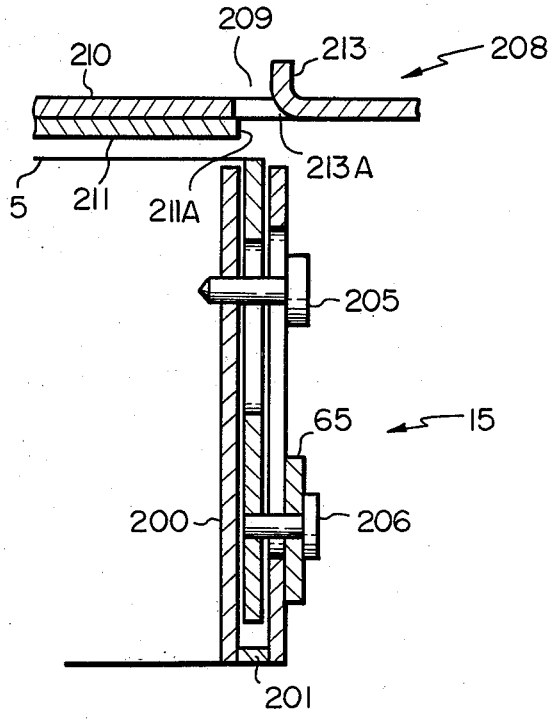
FIG. 5 is a fragmentary side elevational view in cross-section of the cutter device of the printer as shown in FIG. 1.
Figure 6:
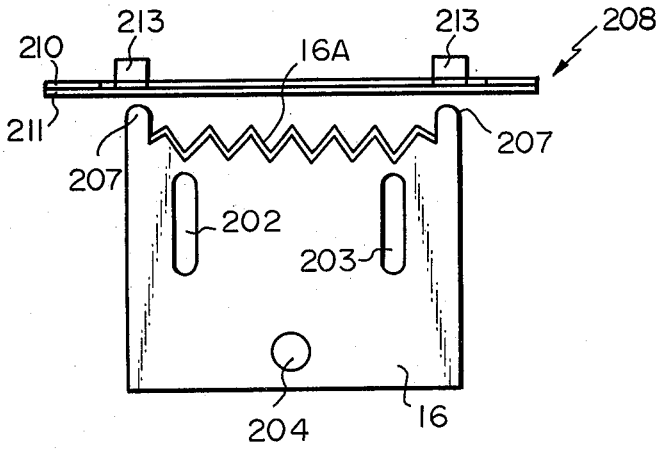
FIG. 6 is a fragmentary top plan view of the cutter device as shown in FIG. 5.
Figure 7:
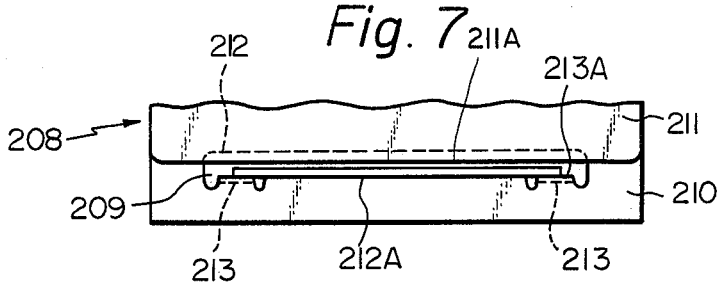
FIG. 7 is a fragmentary bottom plan view of the cutter guide for the cutter of the cutter device as shown in FIG. 5.

The cutter device which constitutes another feature of the present invention will be now in detail described referring to FIGS. 5 through 7. As shown in these figures, the cutter device 15 includes a cutter 16 received in the space defined between frame members 200, 201 which are secured to the main body of the printer in spaced relationship to each other. As more clearly shown in FIG. 6, the cutter 16 has a continuous saw tooth-shaped cutting edge 16A and two spaced and parallel elongated slots 202, 203 and a center circular hole 204 positioned between and below the slots 202, 203. Screws extend loosely through the elongated slots 202, 203 and are screwed into the printer main body so that the cutter 16 can move vertically within the slots by being guided by the screws and a screw 206 secured to the cutter actuation lever 65 engages in the circular hole 204 so that as the lever 65 rocks, the cutter 16 is moved upwardly and downwardly. The cutter 16 has guide projections 207 formed at the opposite ends of the saw tooth-shaped cutting edge 16A. A cutter guide 208 having a slit 209 therein is attached to the printer main body above and spaced from the horizontal paper transfer plane 5 with the slit 209 facing the cutter 16. The cutter guide 208 comprises two plates 210, 211 laid one upon another and the upper plate 210 has a relatively wide opening 212 and a pair of upright projections 213, 213 opposite to the cutter guide projections 207, 207 on the cutter 16. The inner surfaces or guide faces 213A of the upright projections 213 align with the cut face 212A of the opening 212 in the upper plate 210, but curve at the junctures between the upright projections 213 and the rest of the upper plate 210 as shown in FIG. 5. The leading end of each of the guide projections 207 on the cutter 16 opposes to the adjacent curved juncture. As shown in FIGS. 5 and 7 the lower plate 211 of the cutter guide 208 forms a cut face 211A at the end edge that slightly overlaps slit 209 to define a slightly smaller slit having a width substantially corresponding to the thickness of the cutter 16 in cooperation with the cut face 212A in the upper cutter plate 210.

With the above-mentioned construction and arrangement of the components of the cutter device 15, as the cutter 16 is moved upwardly by the rocking movement of the cutter lever 63 and cutter actuation lever 65, the guide projections 207 on the cutter 16 first abut against the curved junctures between the guide faces 213A and the rest of the upper cutter guide plate 210 and are then guided along the curved junctures into the slit 209. In this way, the portion of the cutter 16 following the cutting edge 16A thereof is smoothly and positively guided within the slit 209 in the cutter guide 208.

Figure 8:
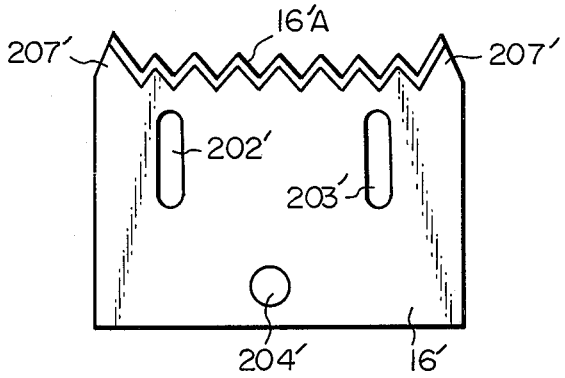
FIG. 8 is a top plan view of a modified cutter.

The above-mentioned cutter 16 can be replaced by the modified cutter 16' as shown in FIG. 8 and the modified cutter 16' also has spaced and parallel elongated slots 202', 203' in which screws 205 engage to guide the cutter and a circular hole 204' in which the screw 206 engages so that the cutter is moved upwardly and downwardly by the cutter actuation lever 65. The teeth 207', 207' at the opposite ends of the saw tooth-shaped cutting edge 16'A are higher than the remaining teeth to form extension which function in the same manner as the projections 207, 207 on the cutter 16 as shown in FIG. 6. The undersurface of the cutter guide 208 rises stepwise from the lower cutter plate 211 to the upper cutter plate 210 in the transfer direction of the receipt paper 1 and accordingly, even when the cut edge of the receipt paper 1 curls upwardly somewhat, the curled cut edge is prevented from being trapped in the slit 209 as the receipt paper 1 is transferred following the cutting operation.

As is clear from the foregoing description of the present invention, since the arrangement for guiding the cutter of the cutter device into the slit is formed in this way, the smooth guiding of the cutter can be achieved, the positioning of the components of the cutter device in assembling the cutter components can be effected without difficulties, improved sharpness of the cutter can be attained by limiting the slit width to a minimum practical value and possible clogging of the slit with the cutter is also eliminated.

Next, the mounting arrangement for the optical detector or the detection device for detecting the above-mentioned printing position which constitutes another feature of the present invention will be now in detail described.

Figure 9:
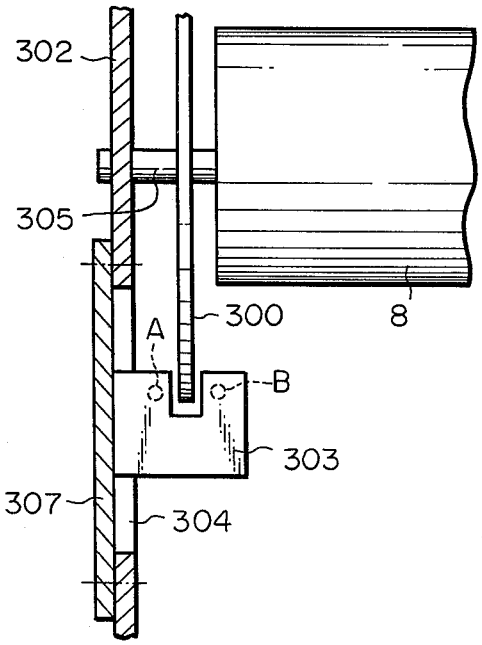
FIG. 9 is a side elevational view in partial cross-section showing the mounting of the optical detector of the present invention.
Figure 10:
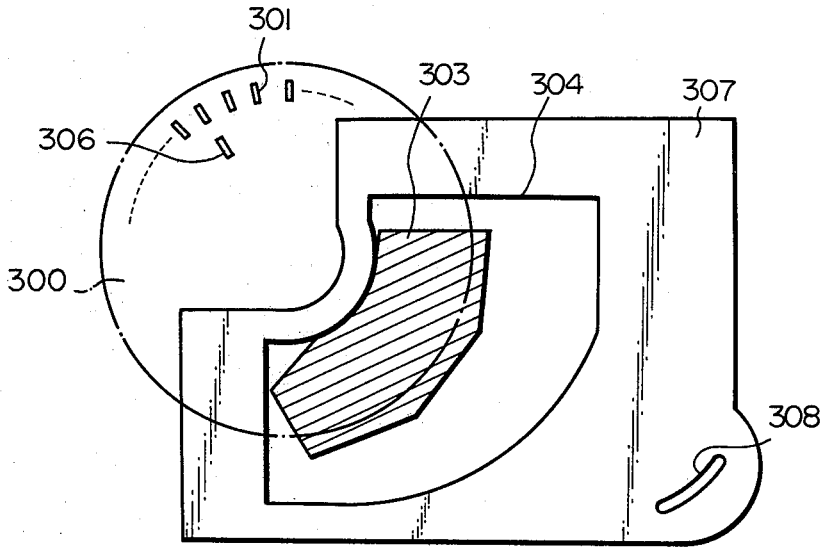
FIG. 10 is a front elevational view of FIG. 9.

As shown in FIG. 9, a disc 300 is attached to the outer periphery of the printing drum 8 associated with the receipt paper 1 or journal paper 6 on which the characters to be printed are formed for rotation with the drum 8. The disc 300 has a plurality of angularly spaced openings 301 formed adjacent to the outer periphery of the disc corresponding to the character rows formed on the outer periphery of the printing drum 8, respectively. The printing drum 8 and disc 300 are journalled in a side plate 302 of the printer main body by means of a shaft 305 and the side plate is formed with an opening 304 having a size sufficient to permit the detection section 303 to be inserted from outside as shown in FIGS. 9 and 10. As well known in the art, the detection section 303 includes a luminous element A and a light receiving element B which are disposed facing and spaced from the opposite sides of the disc 300 in the same radial distance as the openings 301 in the disc from the shaft 305. The detector functions to detect that the light receiving element B receives the light from the luminous element A through the openings 301 to thereby confirm individual printings of desired or selected characters on the printing drums 8. The disc 300 also has one reset opening 306 formed therein and elements associated with the reset opening 306 are also incorporated in the detection section 303 whereby the detector rests each time the discs or printing drums have rotated through one complete rotation.

The detection section 303 is secured to a print base 307 to form the optical detector and the print base has a size substantially larger than that of the opening 304 as shown in FIG. 10.

With the above-mentioned construction and arrangement of the components of the optical detector, the optical detector is mounted on the printer main body by inserting the detection section 303 of the detector into the opening 304 in the side plate 302 from outside of the side plate and positioning the print base 307 in a predetermined position with respect to the disc 300. In this case, for positioning the detection section 303 in the circumferential direction of the disc 300 especially, the mounting hole for the print base is preferably formed as the elongated slot 308 as shown in FIG. 9.

As clear from the foregoing description of the printer of the invention, the mounting arrangement of the optical detector of the invention is practically advantageous in that the optical detector can be easily positioned and mounted from outside, the mounting operation is improved and the print base serves to shield the detection section insertion opening in the main body to thereby eliminate the necessity of any separate cover.

While preferred embodiments of the invention have been shown and described in detail, it will be understood that the same are for illustration purposes only and not to be taken as a definition of the invention, reference being had for this purpose to the appended claims.

I claim:

1. A printer of the type in which printing is effected on a receipt paper and a journal paper disposed in parallel to each other, characterized by means for transferring said receipt and journal papers in a horizontal direction, a cutter device adapted to move vertically so as to cut said receipt paper into receipt paper sections after the transfer of the receipt paper, means for guiding said cut receipt paper sections out of said printer in a horizontal direction, a take-up roll for winding said journal paper about the roll after the journal paper has been turned upwardly, separate printing drums for said receipt and journal papers disposed below a horizontal paper transfer plane and separate printing hammers for said receipt and journal papers disposed above said horizontal transfer plane to effect printing on the undersurface of the papers in cooperation with said printing drums, respectively.

2. The printer as set forth in claim 1, further including magnets for transferring said receipt paper and journal paper, respectively, cams for cooperating with said magnets and levers for transferring said receipt paper and journal paper, respectively, whereby the rotational drive forces of motors for rotatably driving said printing drums are transmitted to said respectively associated cams as one complete rotation of the cams through the energization of said magnets for transferring said receipt paper and journal paper respectively and one complete rotation of said cams causes said respectively associated receipt and journal paper transfers levers to rock once so as to feed the papers by one pitch.

3. The printer as set forth in claim 2, further including a mechanism in which one complete rotation of another cam is obtained through the energization of another magnet and one complete rotation of said cam causes said receipt paper transfer lever to rock by an angular distance corresponding to a plurality of pitches.

4. The printer as set forth in claim 3, further including a mechanism for actuating a stamp lever through one complete rotation of still another cam.

5. The printer as set forth in claim 1, further including means for inserting a validation slip either between either said receipt paper or said journal paper and the associated printing drum or between both said receipt and journal papers and the associated printing drums along the undersurface of either said receipt paper or said journal paper or the undersurfaces of both said receipt and journal papers on said horizontal paper transfer plane and on a feed roller to thereby effect printing in a plurality of rows.

6. The printer as set forth in claim 5, further including a slip transfer lever and a cam for cooperating with said lever whereby one complete rotation of said cam causes said slip transfer lever to rock once to thereby rotate said slip transfer roller by one pitch.

7. The printer as set forth in claim 6, in which said slip transfer roller and another cooperating roller are caused to selectively abut against said slip transfer roller through the energization of an electromagnetic plunger and while said slip transfer roller and cooperating roller are in abutment against said slip transfer roller, the leading end of a lever on which said cooperating roller is mounted limits the cutting amount by the cutter of a cutter device to thereby form a perforated line.

8. The printer as set forth in claim 1, further including a block structure comprising a yoke having an electromagnetic iron core, a magnetic coil, plungers and hammers assembled thereto in a predetermined positional relationship and said block structure is adapted to be secured to the main body of said printer in a proper positional relationship relative to said printing drums with the shaft of said hammers as the reference.

9. The printer as set forth in claim 1, further including a cutter and a cutter guide having a slit formed therein for receiving said cutter and in which at least one edge of said cutter is formed with guide portions projecting into the cutting direction in a position outwardly of the adjacent edge of a paper to be cut such as a receipt paper and guide faces are formed at the opposite ends of said slit in the cutter guide projecting from at least one side of the cutter guide opposite to said guide portions on the cutter whereby when the cutter is in the inoperative position, said guide portions on the cutter are spaced from said guide faces of the cutter guide and when the cutter advances into said slit for cutting operation, the guide portions first abut against said guide faces and are then guided into said slit.

10. The printer as set forth in claim 1, in which said cutter guide comprises two cutter guide plates laid one upon another, the cutter guide plate opposite from said cutter is formed with said guide faces extending uprightly in the cutting direction of the cutter, and the other cutter guide plate is adjustably positioned so as to determine the slit width whereby the cutter is first guided along curved junctures between the guide faces and the rest of the associated cutter guide plate.

11. In an optical detector adapted to be incorporated into the printer as set forth in claim 1, characterized by that said optical detector comprises a detection section including a luminous element and a light receiving element opposite to and spaced from said luminous element, a print base to which said detection section is attached and an opening formed in said main body of the printer for receiving said detection section, whereby said optical detection section is inserted through said opening and positioned in a predetermined position and said print base is secured to the main body of the printer so as to shield the opening from external light.

* * * * *

UNITED STATES PATENT AND TRADEMARK OFFICE

CERTIFICATE OF CORRECTION

PATENT NO. : 4,293,236

DATED : October 6, 1981

INVENTOR(S) : Munetaka Shimizu

It is certified that error appears in the above—identified patent and that said Letters Patent is hereby corrected as shown below:

Column 4, line 44 change "3'" to --3--

Signed and Sealed this

*Third* Day of *August 1982*

[SEAL]

*Attest:*

GERALD J. MOSSINGHOFF

*Attesting Officer*

*Commissioner of Patents and Trademarks*